US006555952B1

(12) United States Patent
Park et al.

(10) Patent No.: US 6,555,952 B1
(45) Date of Patent: Apr. 29, 2003

(54) ELECTRON GUN AND CATHODE RAY TUBE USING THE SAME

(75) Inventors: Duk-sung Park, Suwon (KR); Sang-kyun Kim, Seoul (KR); Bong-wook Jung, Seoul (KR); Chul-sik Cho, Chungcheongnam-do (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/522,687

(22) Filed: Mar. 10, 2000

(30) Foreign Application Priority Data

Mar. 11, 1999 (KR) ..... 99-8075

(51) Int. Cl.[7] ..... H01J 29/48
(52) U.S. Cl. ..... 313/414; 313/447

(58) Field of Search ..... 313/414, 447, 313/449, 458

(56) References Cited

U.S. PATENT DOCUMENTS 5,814,930 A * 9/1998 Watanabe et al. ..... 313/414
6,031,326 A * 2/2000 Suzuki et al. ..... 313/414

* cited by examiner

*Primary Examiner*—Sandra O'Shea
*Assistant Examiner*—Bao Truong
(74) *Attorney, Agent, or Firm*—Leydig, Voit & Mayer, Ltd.

(57) ABSTRACT

A final focus electrode includes a cylindrical base on one end and a conical portion on the other end such that the diameter of the conical portion is greater than that of the base and also gradually increases with distance from the base. The conical portion of the final focus electrode is located inside a cylindrical accelerating electrode such that it is coaxially surrounded by the latter.

5 Claims, 4 Drawing Sheets

ELECTRON GUN AND CATHODE RAY TUBE USING THE SAME

BACKGROUND OF THE INVENTION

1. Field of the Invention

The present invention relates to a projection color television tube, and more particularly to an electron gun for such tube having improved high voltage performance.

2. Description of the Related Art

A projection color TV uses three monochrome CRTs to produce the primary colors, i.e., red, blue and green, which are superimposed on a large projection screen to produce a full color display image. Because the images on the tube screens are not viewed directly, but are magnified and projected by a system of projection lenses, the individual cathode ray tubes are driven at higher voltages and beam currents than would be encountered for direct view tubes, in order to produce a full color display of acceptable brightness. U.S. Pat. No. 4,904,898, issued to Penird et al. discloses an electron gun assembly where a focusing electrode is coaxially surrounded by an accelerating electrode. A figure of U.S. Pat. No. 4,904,898 is reproduced here as FIG. 1. It shows an electron gun having a cathode 21 to emit electrons, a control electrode 22, and a screen electrode 23. The electron gun further includes a first focus electrode 24 and a second focus electrode 25. The end portion of the electron gun is coaxially surrounded by an accelerating electrode 26. More particularly, the second focus electrode 25 has a cup-shaped portion, which is comprised of a short cylindrical portion 25*b* and a tapered portion 25*c*, integrally connected to a cylindrical base portion 25*a*. Tapering the wall of the second focus electrode 25 helps to reduce a surface comprising the high voltage gap between the second focus electrode 25 and the accelerating electrode 26. It further increases the distance between the interior surface of the accelerating electrode 26 and the outer surface of the second focus electrode 25. The disclosed electrode structure is stated to have good high-voltage performance. However, because the second focus electrode 25 still has a cylindrical portion 25*b* at one end thereof, there remains a possibility of a particle or projection becoming a field emitting site. There has been no attempt to taper the focusing electrode all the way to the end thereof presumably because it was believed that it is necessary to the main electronic lens.

SUMMARY OF THE INVENTION

To solve the above problem, an object of the present invention is to further improve the high voltage performance of an electron gun for a monochrome cathode ray tube without degrading its lensing performance.

Another object of the present invention is to provide an electron gun for a monochrome cathode ray tube which can be effectively high voltage conditioned.

In accordance with the invention, it has been discovered that the high voltage performance of the monochrome cathode ray still can be achieved by modifying the shape of the focusing electrode such that the end of the focusing electrode is also tapered.

In accordance with the invention, the side walls of the focusing electrode is tapered inwardly from the end.

BRIEF DESCRIPTION OF THE DRAWINGS

The above objects and advantage of the present invention will become more apparent by describing in detail preferred embodiments thereof with reference to the attached drawings in which.

DETAILED DESCRIPTION OF THE INVENTION

Figure 1:
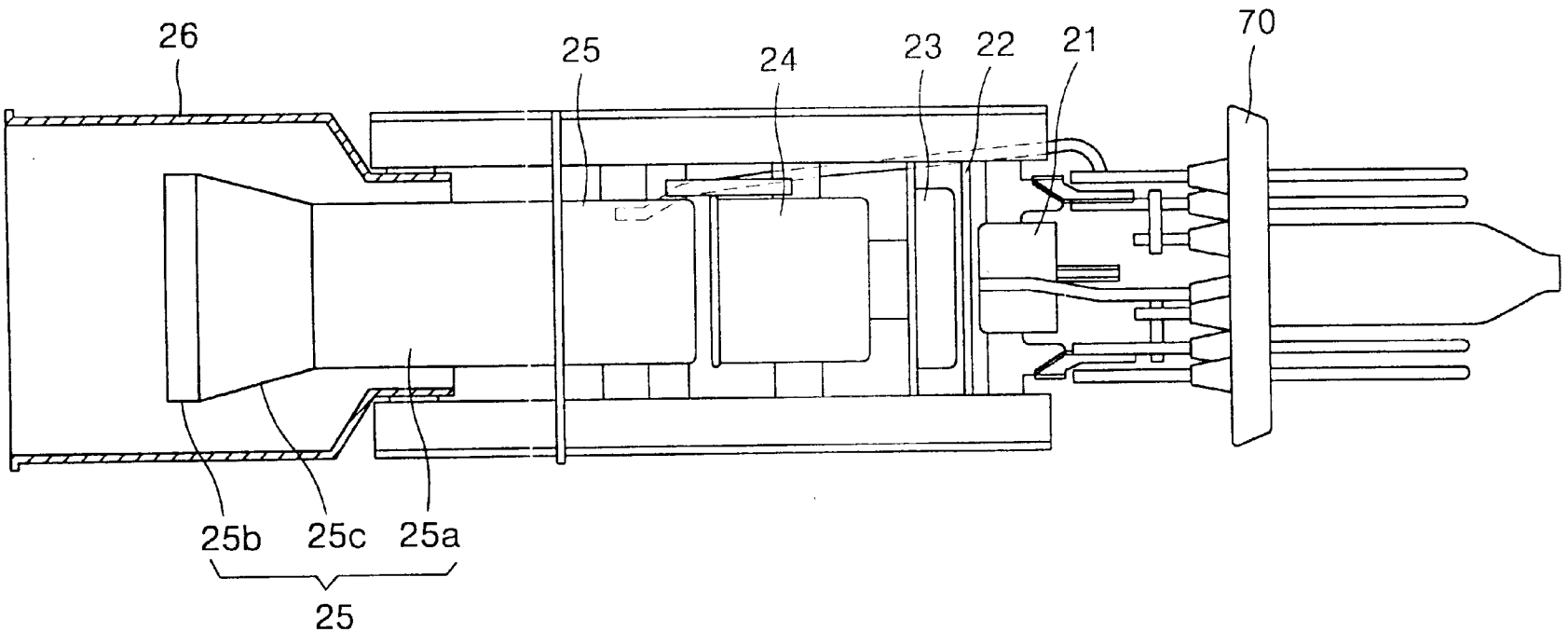
FIG. 1 illustrates a conventional electron gun.
Figure 2:
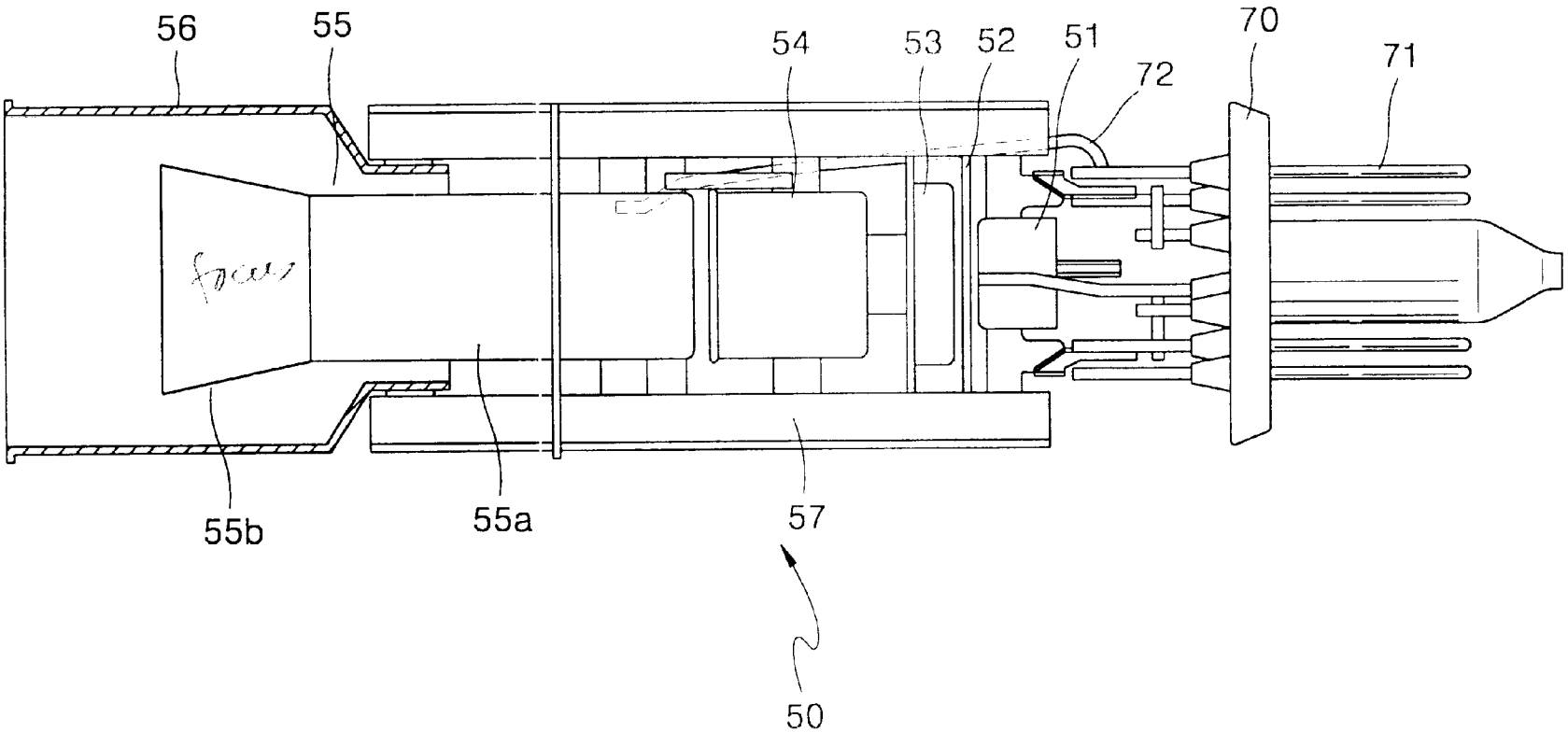
FIG. 2 is a lengthwise cross-sectional view of an electron gun according to the present invention.
Figure 3:
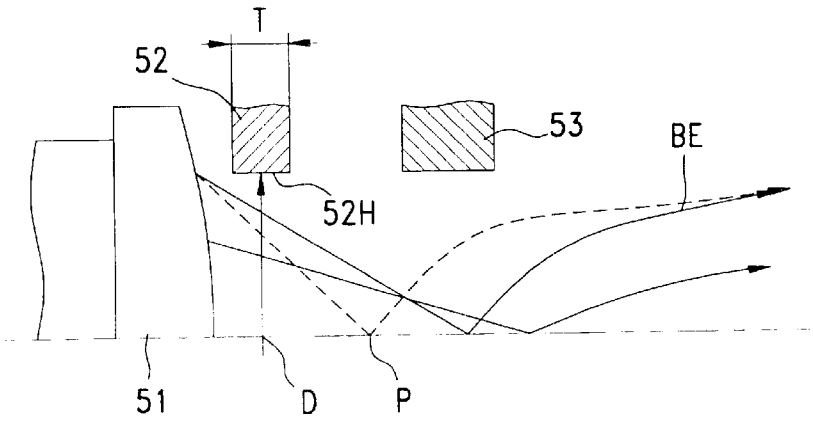
FIG. 3 shows the location of a crossover point with a different control electrode thickness.
Figure 4:
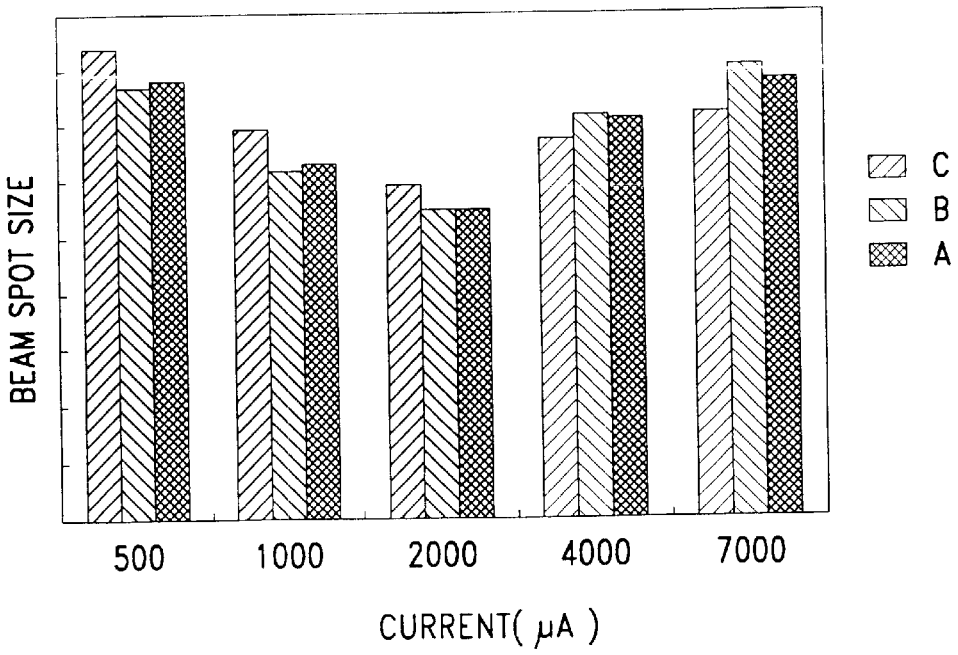
FIG. 4 is a graph illustrating the size of a beam spot with respect to the magnitude of current applied to the electrodes.
Figure 5:
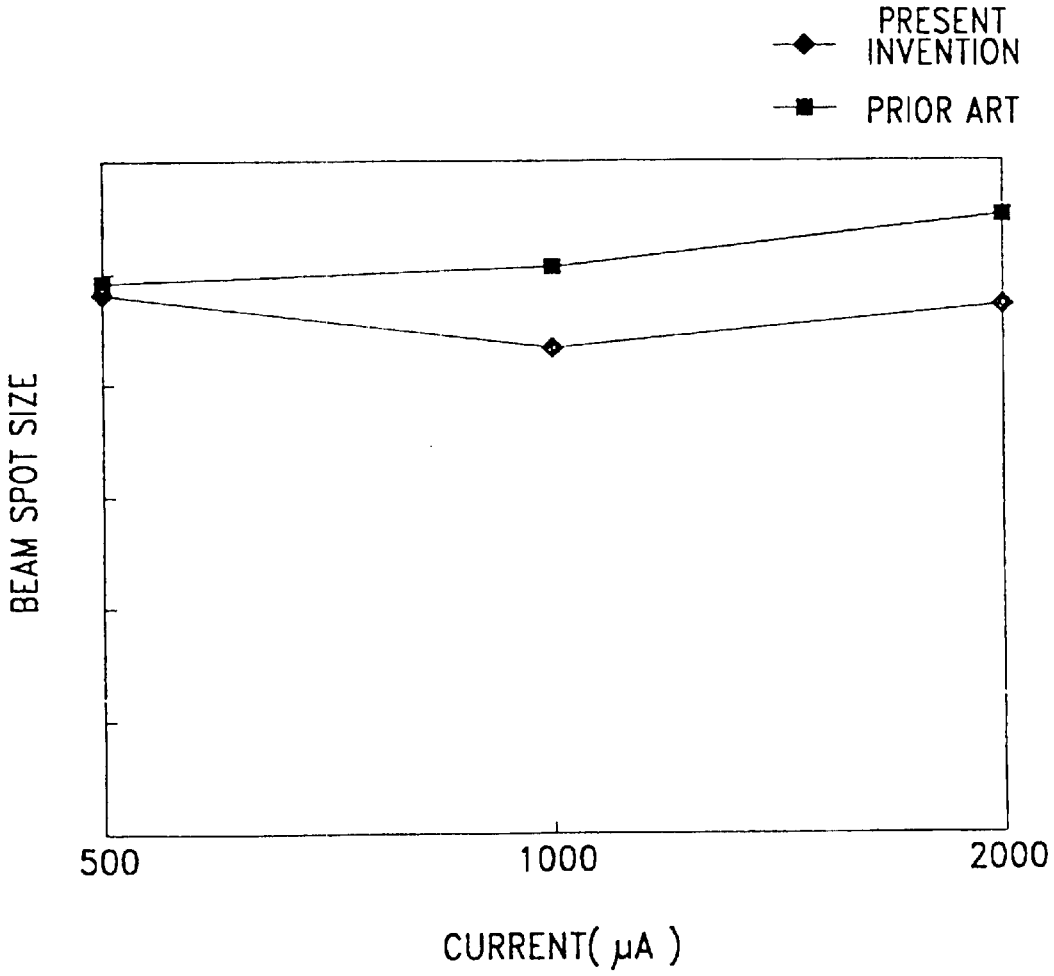
FIG. 5 is a graph illustrating the size of a beam spot with respect to the magnitude of current applied to the electrodes for two different control electrode thicknesses.

Referring to now FIG. 2 the present invention has a cathode 51, a control electrode 52, a screen electrode 53, at least one focus electrode 54, 55 and an accelerating electrode 56 coaxially surrounding a portion of a final focus electrode 55. The final focus electrode 55, in contrast with the prior art, does not have a short cylindrical section at the end of a tapered portion. Namely, the conical wall of the final focus electrode 55 tapers all the way to its end. The tapered portion may be integrally made with the base portion, or it can be separately made and coupled to the base. The angle of the tapered surface made with the central axis of the electron gun is preferably in the range of 10–30 degrees, which ensures sufficient distance between the final focus electrode 55 and the accelerating electrode 56. Thus, it is possible to further improve the high-voltage performance since the surface area including the high-voltage gap between the electrodes becomes minimal. Keeping in mind that the main lensing action of the electron gun on the electron beam occurs in the vicinity of the gap between the final focus electrode 55 and the accelerating electrode 56, it was suspected that the diameter of the effective aperture of the electronic lens formed by the present invention may decrease causing a spherical aberration which would result in a larger electron beam spot. As known in the art, increased beam spots excessively heat the screen, deteriorating the quality of the resultant CRT. However, a computer simulation by the inventors showed no noticeable increase in the spherical aberration. It was further found that at low and medium voltage levels the size of an electron beam spot did not increase enough to deteriorate a resultant image on the screen. Moreover, as shown in FIG. 3, according to the present invention, the thickness T of the control electrode 52 is at least 10% of the diameter D of its beam-passing aperture 52H in order to compensate for a decreased diameter of the aperture of the electronic lens constituted by the final focus electrode 55 and accelerating electrode 56. FIG. 4 illustrates the size of an electron beam spot in response to the current applied to the electrodes. Bar A represents the relation of beam spot size to current in the prior art including a final focus electrode having a tapered portion and a short cylindrical portion at its end. The beam spot size is larger in the low and high current range than in the medium range. Bar B represents the relation of beam spot size to current in the present invention with the final focus electrode 55 having solely a tapered end. One can see that at low to middle current the beam spot is smaller than that of the prior art although it becomes larger at a high current level. This undesirable relative increase in the beam spot size at a high current level can be prevented by providing a control electrode having a thickness of at least 10% of its electron beam-passing aperture. This improvement is achieved because with a thicker control electrode, electrons BE emitted from the periphery of the cathode 51 will have their crossover point P closer to the cathode 51. The dotted path in FIG. 3 is that of electrons passing a thicker control electrode 52. Compared to the trajectory of electrons passing through a thinner control electrode, represented by the solid line, the crossover point moves toward the cathode 51. In this case, the incident angle of the electron beam to the free-focus lens, which is between the screen electrode 53 and the focus electrode 54, becomes greater and, as a result, the incident angle of the electron beam to the main lens becomes smaller, thereby reducing the single beam spot landing on the screen. In FIG. 4, bar C, i.e., the beam spot according to the present invention, is larger than the bar A according to the prior art at all current levels. An experiment showed that if the control electrode's thickness is less than 10% of the diameter of its aperture, the electron beam spot becomes undesirably larger, as shown in FIG. 5.

What is claimed is:

1. A cathode ray tube comprising an electron gun assembly having a central axis, a control electrode having a thickness and an electron beam-passing aperture with a diameter, the thickness being larger than 10% of the diameter of the electron beam-passing aperture, a focusing electrode coaxial with the central axis, and an accelerating electrode coaxial with the central axis, the focusing electrode comprising an elongated cylindrical base portion and a conical portion having a side wall and joined to the cylindrical base portion, the accelerating electrode axially surrounding the conical portion of the focusing electrode, wherein the side wall of the conical portion is tapered from the cylindrical base portion to a free end of the focusing electrode.

2. The cathode ray tube according to claim 1, wherein the side wall of the conical portion is tapered with respect to the central axis of the electron gun at an angle ranging from 10 to 30 degrees.

3. A cathode ray tube comprising an electron gun assembly having a central axis, a control electrode having a thickness and an electron beam-passing aperture with a diameter, an accelerating electrode coaxial with the central axis, and a focusing electrode coaxial with the central axis and partially inside and spaced from the accelerating electrode, the focusing electrode comprising a tubular portion consisting of an elongated cylindrical base portion and a conical portion joined to the cylindrical base portion, the accelerating electrode axially surrounding the conical portion of the focusing electrode.

4. The cathode ray tube according to claim 3, wherein the thickness of the control electrode is larger than 10% of the diameter of the electron beam-passing aperture in the control electrode.

5. The cathode ray tube according to claim 3, wherein the conical portion forms an angle with the central axis of the electron gun ranging from 10° to 30°.

* * * * *